US005177855A

United States Patent [19]

Shimai

[11] Patent Number: 5,177,855

[45] Date of Patent: Jan. 12, 1993

[54] METHOD AND APPARATUS FOR FORMING ELEMENT-FREE SPACES IN SLIDE FASTENER CHAIN

[75] Inventor: Hideo Shimai, Toyama, Japan

[73] Assignee: Yoshida Kogyo K. K., Tokyo, Japan

[21] Appl. No.: 799,104

[22] Filed: Nov. 27, 1991

[30] Foreign Application Priority Data

Nov. 29, 1990 [JP] Japan ..... 2-331495

[51] Int. Cl.[5] ..... A41H 37/06; B21D 53/50

[52] U.S. Cl. ..... 29/408; 29/426.5; 29/770

[58] Field of Search ..... 29/408, 410, 426.5, 29/770, 33.2; 83/921

[56] References Cited

U.S. PATENT DOCUMENTS 2,877,844 3/1959 Burbank .
2,987,809 6/1961 Burbank .
3,063,323 11/1962 Graf .
4,131,223 12/1978 Aureli .
4,307,499 12/1981 Isella .
4,573,383 3/1986 Matsumoto ..... 29/408

FOREIGN PATENT DOCUMENTS 56-52565 12/1981 Japan .

*Primary Examiner*—P. W. Echols
*Attorney, Agent, or Firm*—Hill, Steadman & Simpson

[57] ABSTRACT

Discrete coupling elements of a slide fastener chain are removed by using an apparatus comprising a pair of pressure pads, a punch, cutters, a pair of guides, and a die. To form element-free spaces on the slide fastener chain, coupling elements are removed by clamping interengaged coupling elements by the punch and die, cutting forked legs by the cutter, and removing the cut legs from both sides of the slide fastener chain.

8 Claims, 3 Drawing Sheets

METHOD AND APPARATUS FOR FORMING ELEMENT-FREE SPACES IN SLIDE FASTENER CHAIN

BACKGROUND OF THE INVENTION

1. Field of the Invention

This invention relates to a method of partially removing molded synthetic resin or metal coupling elements, each of which comprises a head and a pair of forked legs holding a fastener tape, from a pair of faster tapes of a slide fastener chain to form element-free space portions on the slide fastener chain.

2. Description of the Related Art

One method of removing molded synthetic resin coupling elements, each of which comprises a head and a pair of forked legs holding a fastener tape, from a slide fastener chain is disclosed in Japanese Patent Publication Sho 48-32222 (1973). With this citation, a pair of punches sandwich interengaged coupling elements, pressing their forklike legs to make them thin enough to deform easily. Then, the legs are freed from the punches to pull the fastener tapes from the coupling elements.

Japanese Patent Publication Sho 56-52565 (1981) discloses another method. Heads of interengaged coupling elements are sandwiched and pressed by push and remove blocks having a pair of claws at their leading edges, so that legs of the coupling elements are loosened and heads of the coupling elements are crushed to move them to the right and left. Then, the claws at the leading edge of a clamp are contacted with the loosened legs to open them further. After this, the push and remove blocks sandwiching the coupling elements are lowered to remove the coupling elements.

With the former method, not only the legs of the coupling elements but also edges of the fastener tapes are pressed and deformed, which would deteriorate the quality of the tape fabric. Plastic legs would be partially destroyed, remaining stuck to the edges of the fastener tapes, which will cause various troubles in subsequent steps of production. Since the fastener tapes are pulled from the coupling elements, coupling elements near the removed area would be disengaged or cracked. Such disengaged coupling elements would have to be readjusted.

With the latter case, the claws of the push and remove blocks cut into the coupling elements, so that the edges of the fastener tapes would be also moved when the heads are crushed and moved laterally. The tape edges would be damaged as they are caught by the claws. Like the former case, the legs of the coupling elements would not be disengaged and remain stuck to the tape edges, thus resulting in incomplete removal of the coupling elements.

SUMMARY OF THE INVENTION

It is therefore an object of this invention to provide a method of removing coupling elements from a slide fastener tape to form element-free spaces thereon without damaging the slide fastener tapes.

Another object of this invention is to provide an apparatus for removing the coupling elements from the slide fastener tapes.

According to a first aspect of this invention, there is provide a method for forming element-free spaces in a slide fastener chain including a pair of rows of interengaged discrete coupling elements mounted on confronting edges of a pair of fastener tapes, said method comprising the steps of: clamping, between a coacting punch and die, heads of the interengaged coupling elements at a space-forming section of the slide fastener chain; cutting one of two legs of each of the clamped coupling elements off the individual head; and removing the other leg and head of each of the cut coupling elements from the respective fastener tape.

According to a second aspect of the invention, there is provided an apparatus for forming element-free spaces in a slide fastener chain including a pair of rows of interengaged discrete coupling elements mounted on confronting edges of a pair of fastener tapes, said apparatus comprising: a pair of guides for guiding the fastener tapes of the slide fastener chain along a longitudinal path; a coacting punch and die located upwardly and downwardly of a central gap of said guides and movable vertically toward each other to clamp heads of the interengaged coupling elements at a space-forming section of the slide fastener chain and movable as a unit upwardly or downwardly with the heads clamped between said punch and die; and means for cutting one of two legs of each of the clamped coupling elements off the individual head.

DETAILED DESCRIPTION

Figure 1:
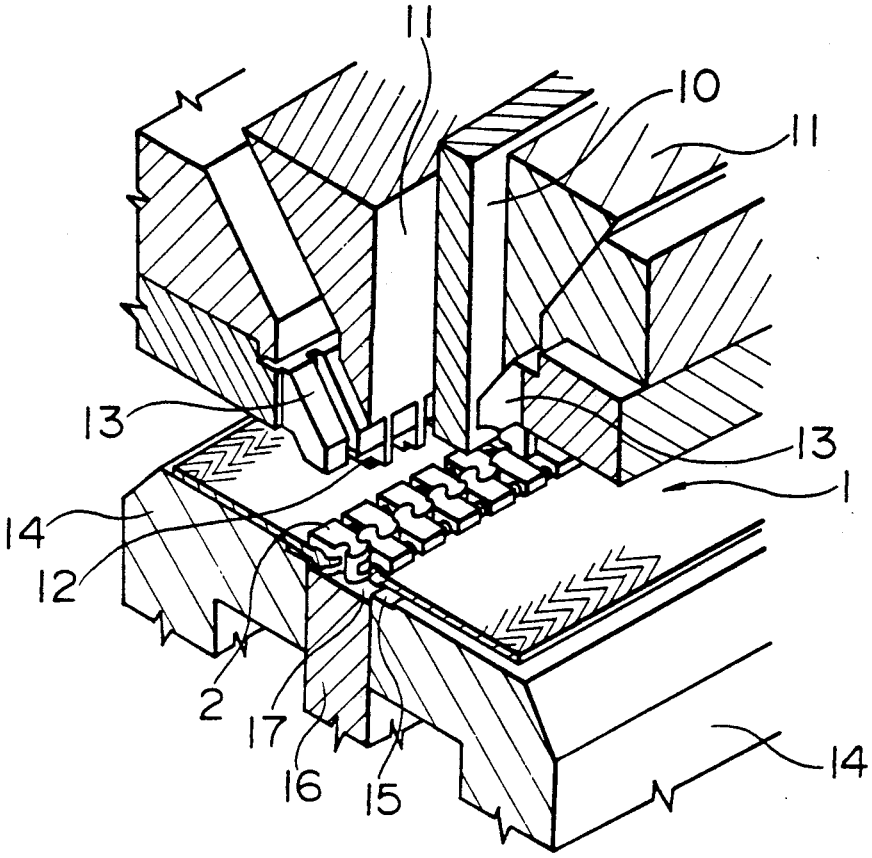
FIG. 1 is a fragmentary cross-sectional view of an apparatus for removing coupling elements, according to one embodiment of this invention.
Figure 2:
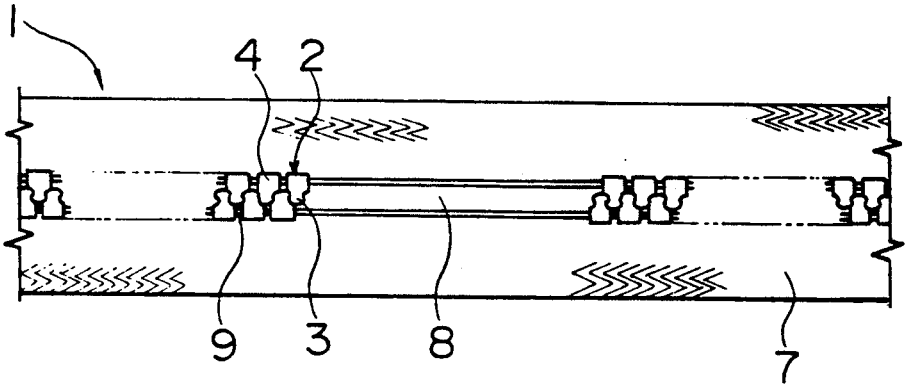
FIG. 2 is a plan view showing a slide fastener tape having an element-free space.
Figure 3A:
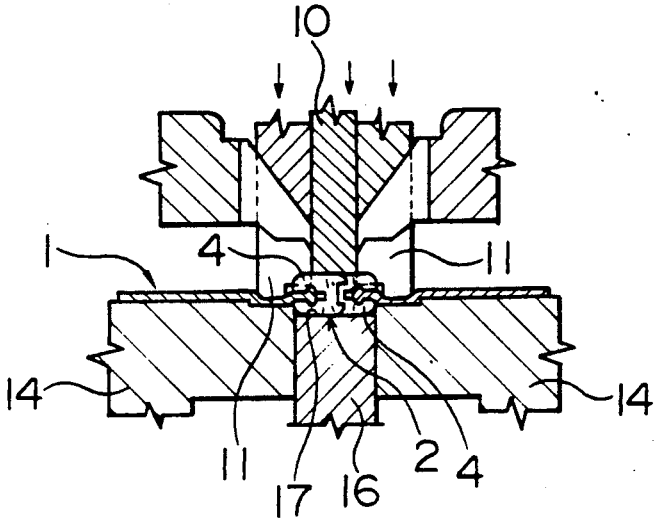
FIGS. 3(*a*) to 3(*d*) are cross-sectional views showing how coupling elements are removed.
Figure 3B:
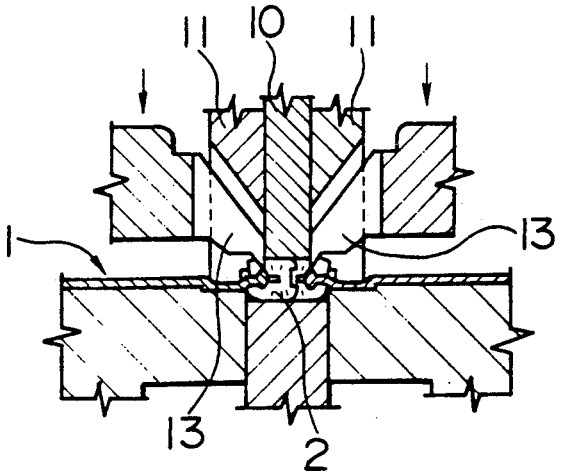
Figure 3C:
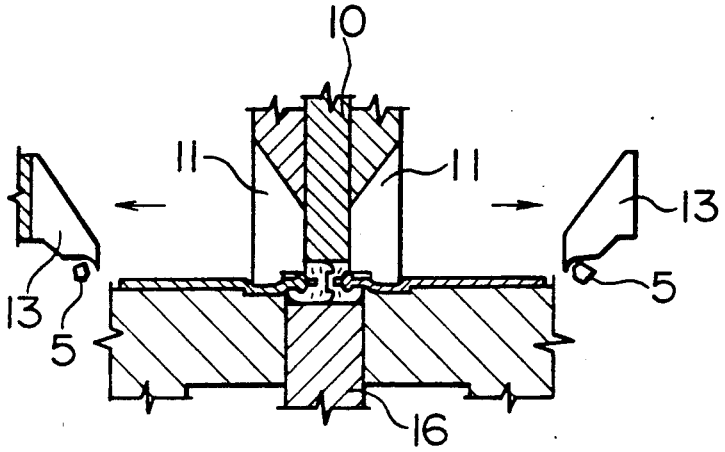
Figure 3D:
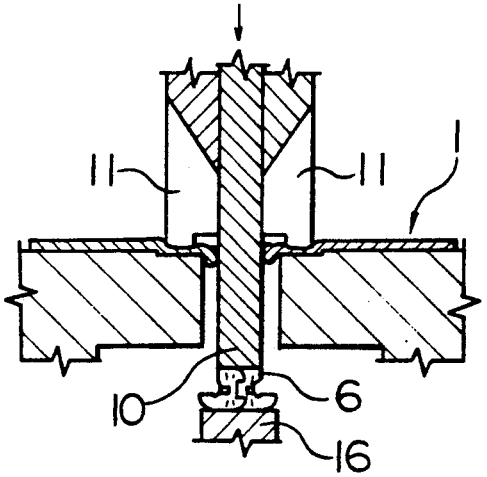

An embodiment of this invention will be described with reference to the drawing figures. An apparatus for removing coupling elements comprises an upper unit and a lower unit. The upper unit includes a punch 10, a pair of pressure pads 11 symmetrically arranged at opposite sides of the punch 10. The pressure pads 11 are set in motion by a drive mechanism such as a fluid cylinder or a cam mechanism, not shown. The lower unit includes a die 16, and a pair of guides 14 at opposite sides of the die 16. A slide fastener chain 1 is placed on the guides 14 and the die 16.

The punch 10 is located just above a central portion of the fastener chain 1, being reciprocated by a drive mechanism such as a fluid cylinder (not shown). In cooperation with the die 16, the punch 10 sandwiches heads 3 of coupling elements 2 to be removed to form a space 8 on the slide fastener chain 1.

Each pressure pad 11 includes at its edge a number of comb-tooth-like pushers 12, which enter into gaps 9 between coupling elements 2 of the fastener tapes 7 to press the inner edges of the fastener tapes 7. The pressure pads 11 are descended by the drive mechanism via springs, thereby elastically pressing the fastener tapes 7.

Each cutter 13 includes a plurality of bill-like edges, which advance between the pushers 12 of the pressure pad 11 to cut portions between the heads 3 and legs 4 of the coupling elements 2. The cutters 13 are moved vertically and horizontally by the drive mechanism such as a fluid cylinder or a cam mechanism, as shown in FIGS. 3(*a*) to 3(*d*), cutting the legs 4 of the coupling elements 2 and removing cut chips 5.

The guides 14 are fixedly positioned at opposite sides of the die 16 to receive and guide the slide fastener chain 1. Each guide 14 has a step 15 on its upper inner edge near the die 16 as shown in FIGS. 1 and 3. The coupling elements 2 and adjacent areas of the fastener tape fit in the space formed by the steps 15 and the die 16, where they are resiliently pressed by the pushers 12 of the descended pressure pads 11.

The die 16 is positioned between the guides 14, being vertically moved by the drive mechanism to sandwich the coupling elements 2 of the slide fastener tapes 7 together with the punch 10. The die 16 has a width equal to the length of the interengaged coupling elements 2. As shown in FIG. 3(*a*), the die 16 is brought down lower than the guides 14, forming a concavity 17 defined by its upper surface and the side walls of the guides 14. The lower halves of the coupling elements 2 are received in the concavity 17 to cut the legs 4 of the coupling elements 2 and eliminate cut chips 5 reliably.

FIG. 3(*a*) to 3(*d*) show how coupling elements are removed to form an element-free space on the slide fastener tape 1. Usually, the punch 10, pressure pads 11 and cutters 13 are at their upper standby positions as shown in FIG. 1. When the slide fastener tapes 1 are advanced on the guide 14 to a preset extent determined by a distance meter including a supply roller with an encoder, the slide fastener tapes 1 are stopped. As shown in FIG. 3(*a*), the pressure pads 11 are descended, so that the pushers 12 of the pressure pads 11 are inserted into gaps 9 between coupling elements 2, elastically pushing the fastener tapes along the coupling elements 2 to resiliently and immovably hold a portion of the fastener tapes 7 where the coupling elements should be removed to form an element-free space.

Then the punch 10 is descended to sandwich the heads 3 of the interengaged coupling elements 2, in a region to form the element-free space, in cooperation with the die 16. As shown in FIG. 3(*b*), the cutter 13 descends to cut the coupling elements 2 between their heads 3 and legs 4 near the core threads along the edges of the fastener tapes 7, thereby cutting and separating the heads 3 and legs 4 on the upper side of the slide fastener tapes 7. Then, the cutters 13 are moved to the right and left, respectively, to move cut chips 5 outwardly of the slide fastener tapes 7. The cut chips will be completely discharged from the slide fastener tapes 7 by a sucking unit or a blower.

As shown in FIG. 3(*d*), both the punch 10 and die 16 are descended with the cut heads of the coupling elements 2 sandwiched between them. The legs 4 and heads 3 of the coupling elements 1 remaining on the under surface of the slide fastener tapes 7 will be pushed downwardly to be removed from the fastener tapes 7. After this, only the punch 10 is raised to release itself from the die 16. The cut chips 6 on the die 16 are put aside by the sucking unit or blower.

The punch 10, pressure pads 11, cutters 13 and die 16 are returned to their standby positions to get ready for a succeeding removal process. The foregoing steps are repeated to form element-free spaces 8 at specified positions of the slide fastener chain 1. Then, the slide fastener chain 1 will be carried to the final process.

According to this invention, the legs and heads of the coupling elements on one side of the slide fastener tape are firstly cut and removed from the fastener tapes. Then the remaining legs and heads on the other side of the slide fastener tapes are descended on the die 16, thereby being detached from the edges of the fastener tapes. Mechanical shocks generated to cut the legs of the coupling elements are applied only to a small area near the tape edges without any damage to the fastener tapes. The coupling elements can be completely removed, forming neat element-free spaces. Further, since the fastener tapes are resiliently held by the pressure pads, interengaged coupling elements near the cut area can remain interengaged, so that the fastener tapes can be guided to a succeeding step without any inconvenience.

The apparatus for removing the coupling element comprises the punch and die to sandwich and descend the heads of the coupling elements, and the cutters for cutting only one side of the forklike legs. The apparatus is therefore very simple and compact, and easy to operate.

What is claimed is:

1. A method for forming element-free spaces in a slide fastener chain including a pair of rows of interengaged discrete coupling elements mounted on confronting edges of a pair of fastener tapes, said method comprising the steps of:
   (a) clamping, between a coacting punch and die, heads of the interengaged coupling elements at a space-forming section of the slide fastener chain;
   (b) cutting one of two legs of each of the clamped coupling elements off the individual head; and
   (c) removing the one leg of each of the cut coupling elements from the respective fastener outwardly of the coupling element rows;
   (d) removing the other leg and head of each of the cut coupling elements from the respective fastener tape.

2. A method according to claim 1, wherein the coupling elements are synthetic resin.

3. A method according to claim 1, wherein the coupling elements are metal.

4. A method according to claim 1, wherein the other leg and head of each of the cut coupling elements are removed from the respective fastener tape perpendicularly of the general plane of the fastener tape.

5. A method according to claim 1, wherein simultaneously with said cutting, the confronting edges of the fastener tapes are clamped at portions between adjacent coupling elements.

6. An apparatus for forming element-free spaces in a slide fastener chain including a pair of rows of interengaged discrete coupling elements mounted on confronting edges of a pair of fastener tapes, said apparatus comprising:
   (a) a pair of guides for guiding the fastener tapes of the slide fastener chain along a longitudinal path;
   (b) a coacting punch and die located upwardly and downwardly of a central gap of said guides and movable vertically toward each other to clamp heads of the interengaged coupling elements at a space-forming section of the slide fastener chain and movable as a unit upwardly or downwardly with the heads clamped between said punch and die; and
   (c) means vertically movable for cutting one of two legs of each of the clamped coupling elements, said cutting means being movable horizontally and perpendicularly to the fastener tapes for removing the cut coupling elements from the respective fastener tapes.

7. An apparatus according to claim 6, further including a pair of pressure pads movable vertically toward and away from said guides for clamping the confronting edges of the fastener tapes at portions between adjacent coupling elements clamped between said punch and die.

8. An apparatus according to claim 7, wherein each of said pressure pads has a pusher for pushing the respective one of the confronting edges of the fastener tapes at portions between the coupling elements against the respective guides.

* * * * *